US005857945A

United States Patent [19]

Papp et al.

[11] Patent Number: 5,857,945

[45] Date of Patent: Jan. 12, 1999

[54] ELASTIC EXERCISE APPARATUS

[76] Inventors: Rudolph F. Papp; Valiant R. Papp; Veronica Papp, all of 18 Mohawk Road East Apt. No 311, Hamilton, Ontario, Canada, L9A 2G6

[21] Appl. No.: 866,141

[22] Filed: May 30, 1997

[51] Int. Cl.[6] ..... A63B 21/02

[52] U.S. Cl. ..... 482/124; 482/121; 482/125

[58] Field of Search ..... 482/121, 122, 482/124, 125, 126

[56] References Cited

U.S. PATENT DOCUMENTS 4,019,734 4/1977 Lee et al. ..... 482/125

4,040,620 8/1977 Friedman ..... 482/125

4,889,336 12/1989 Schneiderman ..... 482/125

5,318,494 6/1994 Santighian ..... 482/125

*Primary Examiner*—Lynne A. Reichard

[57] ABSTRACT

An elastic exercise apparatus is provided including an interconnection housing. Further provided is an elastic lower closed loop connected to the interconnection housing for receiving feet of a user. Also included is an elastic upper closed loop connected to the interconnection housing for being strung about a rear portion of a neck of a user. By this structure, the loops provide a resistive force upon the user extending legs thereof during exercise.

4 Claims, 2 Drawing Sheets

FIG. 2
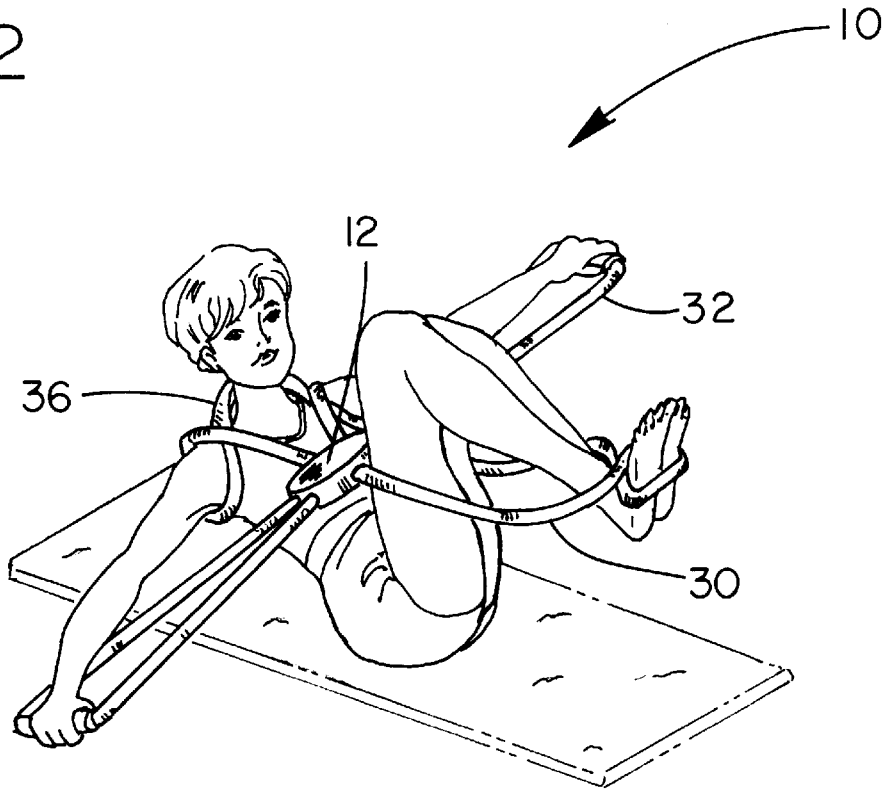
FIG. 3
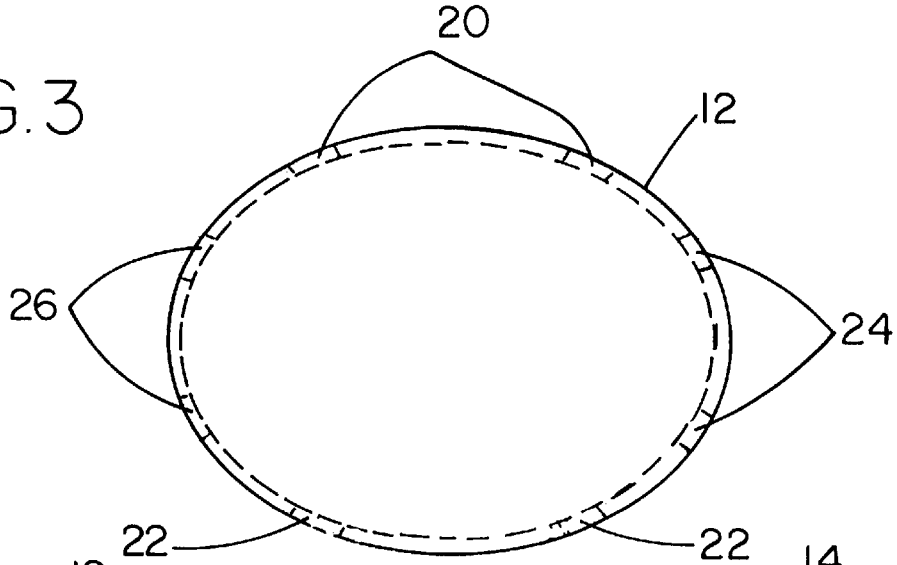
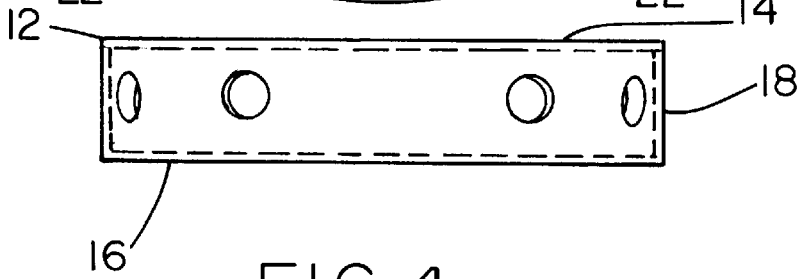
FIG. 4

ELASTIC EXERCISE APPARATUS

BACKGROUND OF THE INVENTION

1. Field of the Invention

The present invention relates to an elastic exercise apparatus and more particularly pertains to allowing the exercise of an individual while in a prone position.

2. Description of the Prior Art

The use of exercise apparatuses is known in the prior art. More specifically, exercise apparatuses heretofore devised and utilized for the purpose of facilitating various exercises are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,318,494 to Santighian; U.S. Pat. No. 4,245,840 to van Housen; U.S. Pat. No. 4,121,827 to Weider; U.S. Pat. No. Des. 350,576 to Richardson; U.S. Pat. No. 4,033,580 to Paris; and U.S. Pat. No. 4,057,246 to Wilson.

In this respect, the elastic exercise apparatus according to the present invention substantially departs from the conventional concepts and designs of the prior art, and in so doing provides an apparatus primarily developed for the purpose of allowing the exercise of an individual while in a prone position.

Therefore, it can be appreciated that there exists a continuing need for a new and improved elastic exercise apparatus which can be used for allowing the exercise of an individual while in a prone position. In this regard, the present invention substantially fulfills this need.

SUMMARY OF THE INVENTION

In view of the foregoing disadvantages inherent in the known types of exercise apparatuses now present in the prior art, the present invention provides an improved elastic exercise apparatus. As such, the general purpose of the present invention, which will be described subsequently in greater detail, is to provide a new and improved elastic exercise apparatus which has all the advantages of the prior art and none of the disadvantages.

To attain this, the present invention essentially comprises an interconnection housing having an oval bottom face, an oval top face, and a periphery formed therebetween thereby defining an interior space. As shown in FIG. 3, the periphery has a pair of spaced circular top apertures, a pair of spaced circular bottom apertures, a pair of spaced circular first side apertures, and a pair of spaced circular second side apertures. Next provided is a closed loop elastic band. A plurality of sections of the band define a plurality of different loops. For example, a large lower closed loop is defined by a pair of first sections of the band which are extended within the bottom apertures of the interconnection housing. Further, a pair of side closed loops are each defined by an associated pair of second sections of the band which extend within respective side apertures of the interconnection housing. It should be noted that one of the second sections of the band that is associated with each pair of side closed loops is integrally coupled to a respective first section of the band of the lower closed loop. Such integral coupling is positioned within the interconnection housing, as shown in FIG. 1. Each side closed loop further has a handle grip formed thereon. The closed loop elastic band further includes an upper closed loop defined by a pair third sections of the band which extend through the top apertures of the housing. Each third section is integrally coupled to another one of the second sections of each pair of side closed loops.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved elastic exercise apparatus which has all the advantages of the prior art exercise apparatuses and none of the disadvantages.

It is another object of the present invention to provide a new and improved elastic exercise apparatus which may be easily and efficiently manufactured and marketed.

It is a further object of the present invention to provide a new and improved elastic exercise apparatus which is of a durable and reliable construction.

An even further object of the present invention is to provide a new and improved elastic exercise apparatus which is susceptible of a low cost of manufacture with regard to both materials and labor, and which accordingly is then susceptible of low prices of sale to the consuming public, thereby making such elastic exercise apparatus economically available to the buying public.

Still yet another object of the present invention is to provide a new and improved elastic exercise apparatus which provides in the apparatuses and methods of the prior art some of the advantages thereof, while simultaneously overcoming some of the disadvantages normally associated therewith.

Still another object of the present invention is to allow the exercise of an individual while in a prone position.

Lastly, it is an object of the present invention to provide a new and improved elastic exercise apparatus is provided including an interconnection housing. Further provided is an elastic lower closed loop connected to the interconnection housing for receiving feet of a user. Also included is an elastic upper closed loop connected to the interconnection housing for being strung about a rear portion of a neck of a user. By this structure, the loops provide a resistive force upon the user extending legs thereof during exercise.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of the present invention in use.

FIG. 3 is a top view of the interconnection housing of the present invention.

FIG. 4 is a side view of the interconnection housing of FIG. 3.

Similar reference characters refer to similar parts throughout the several views of the drawings.

DESCRIPTION OF THE PREFERRED EMBODIMENT

Figure 1:
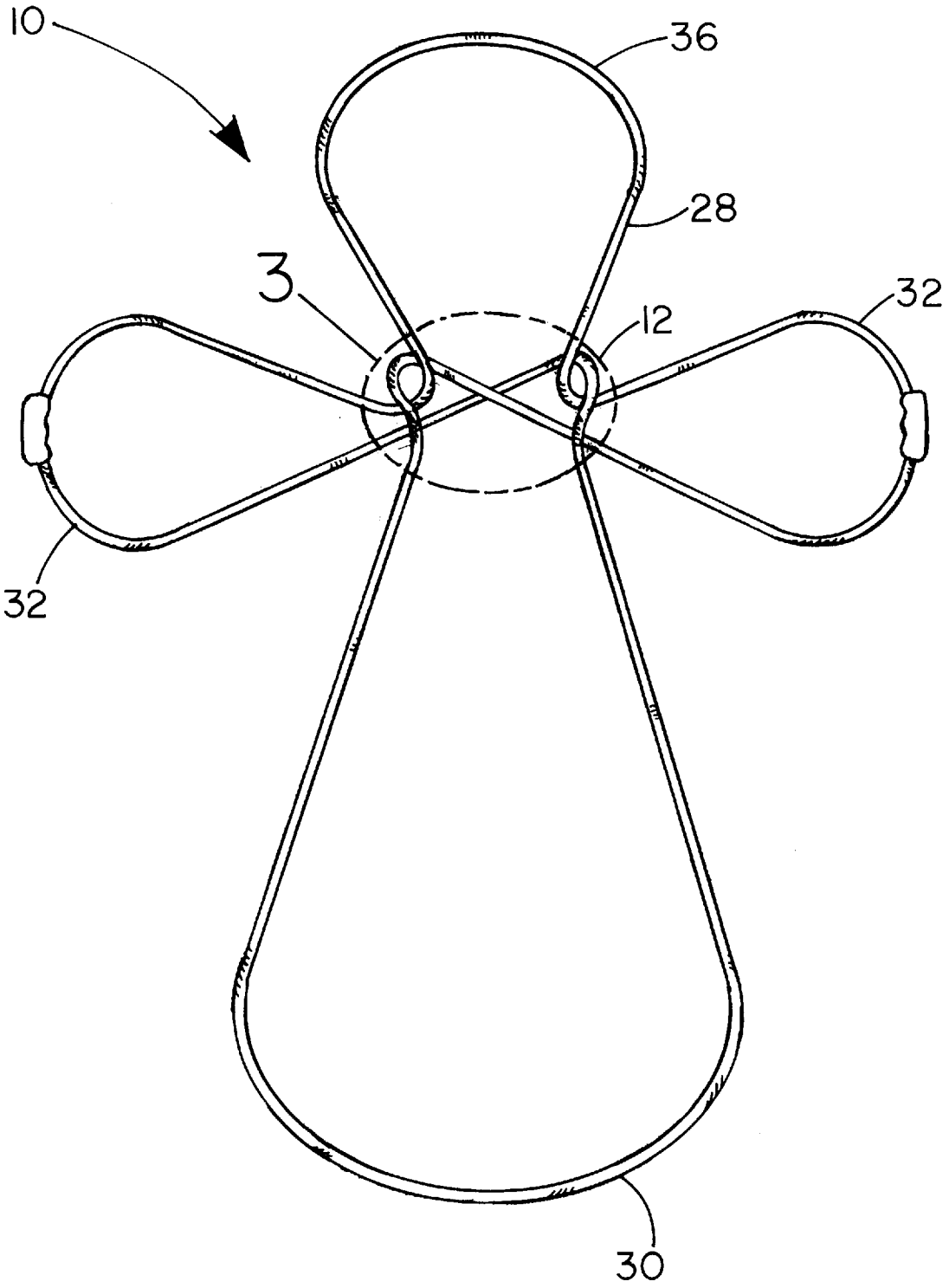
FIG. 1 is an illustration of the preferred embodiment of the elastic exercise apparatus constructed in accordance with the principles of the present invention.

With reference now to the drawings, and in particular to FIG. 1 thereof, a new and improved elastic exercise apparatus embodying the principles and concepts of the present invention and generally designated by the reference numeral 10 will be described.

The present invention, the new and improved elastic exercise apparatus, is comprised of a plurality of components. Such components in their broadest context include an interconnection housing and a plurality of loops connected to such housing. Such components are individually configured and correlated with respect to each other so as to attain the desired objective.

More specifically, it will be noted that the system 10 of the present invention includes an interconnection housing 12 having an oval bottom face 14, an oval top face 16, and a periphery 18 formed therebetween thereby defining an interior space. As shown in FIG. 3, the periphery has a pair of spaced circular top apertures 20, a pair of spaced circular bottom apertures 22, a pair of spaced circular first side apertures 24, and a pair of spaced circular second side apertures 26. As shown in FIG. 3, the apertures, in one sense, define two sets of apertures located in separate halves of the housing with the apertures of each half being equally spaced.

Next provided is a closed loop elastic band 28. A plurality of sections of the band define a plurality of different loops. For example, a large lower closed loop 30 is defined by a pair of first sections of the band which are extended within the bottom apertures of the interconnection housing. It should be understood that the sections of the present description are defined to be the linear extents of the associated loop. Note FIG. 1.

Further, a pair of side closed loops 32 are each defined by an associated pair of second sections of the band which extend within respective side apertures of the interconnection housing. As shown in FIG. 1, the side closed loops are smaller than the large lower closed loop. It should be further noted that a lower one of the second sections of the band that is associated with each pair of side closed loops is integrally coupled to a respective first section of the band of the lower closed loop. Such integral coupling is positioned within the interconnection housing, as shown in FIG. 1. Each side closed loop further has a handle grip 34 formed thereon. Each hand grip ideally has a cylindrical configuration with a plurality of undulations formed therein.

The closed loop elastic band further includes an upper closed loop 36 defined by a pair third sections of the band which extend through the top apertures of the housing. As shown in FIG. 1, the upper closed loop is larger than the side loops and smaller than the lower loop. Each third section is integrally coupled to an upper one of the second sections of the adjacent side closed loop. Further, as shown in FIG. 1, the coupling of the upper loop with the side loops is in contact with the interconnection of the side loops and the lower loop.

By the forgoing structure, the upper closed loop is twisted twice to form a pair of lateral secondary loops for receiving arms of a user. The lower closed loop is twisted to form a single secondary loop for receiving feet of the user. Further, the grips of the side closed loops are adapted to be handled by the user such that the interconnection housing resides above a chest of the user thereby providing a resistive force upon the user extending the arms and legs thereof while in the prone position.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved elastic exercise apparatus comprising, in combination:

an interconnection housing having an oval bottom face, an oval top face, and a periphery formed therebetween thereby defining an interior space, the periphery having a pair of spaced circular top apertures, a pair of spaced circular bottom apertures, a pair of spaced circular first side apertures, and a pair of spaced circular second side apertures; and a closed loop elastic band with a large lower closed loop defined by a pair of first sections of the band which are extended within the bottom apertures of the interconnection housing, a pair of side closed loops each defined by an associated pair of second sections of the band which extend within respective side apertures of the interconnection housing, wherein one of the second sections of the band of each pair of side closed loops is integrally coupled to a respective first section of the band of the lower closed loop within the interconnection housing, each side closed loop further having a handle grip formed thereon, the closed loop elastic band further including an upper closed loop defined by a pair of third sections of the band which extend through the top apertures of the housing with each third section integrally coupled to another one of the second sections of each pair of side closed loops;

whereby the upper closed loop is twisted twice to form a pair of lateral secondary loops for receiving arms of a user, the lower closed loop is twisted to form a single secondary loop for receiving feet of the user, and the grips of the side closed loops are adapted to be handled by the user such that the interconnection housing resides above a chest of the user thereby providing a resistive force upon the user extending the arms and legs thereof.

2. An elastic exercise apparatus comprising:

an interconnection means including a housing having a bottom face, a top face, and a periphery formed therebetween thereby defining an interior space, the periphery having a plurality of spaced circular apertures formed therein;

an elastic lower closed loop connected to the interconnection means for receiving feet of a user; and an elastic upper closed loop connected to the interconnection means for being strung about a rear portion of a neck of a user;

whereby the loops provide a resistive force upon the user extending legs thereof.

3. An elastic exercise apparatus as set forth in claim 2 and further including a pair of side closed loops connected to the interconnection means for being handled by the user.

4. An elastic exercise apparatus as set forth in claim 3 wherein each side closed loop further has a handle grip formed thereon.

* * * * *